US007775832B2

(12) United States Patent
Watanabe

(10) Patent No.: US 7,775,832 B2
(45) Date of Patent: Aug. 17, 2010

(54) HOLDING STRUCTURE OF A CONTACT MEMBER FOR AN ELECTRICAL CONNECTOR

(75) Inventor: Yoshinori Watanabe, Tokyo (JP)

(73) Assignee: Tyco Electronics Japan G.K., Kanagawa (JP)

( * ) Notice: Subject to any disclaimer, the term of this patent is extended or adjusted under 35 U.S.C. 154(b) by 0 days.

(21) Appl. No.: 12/324,171

(22) Filed: Nov. 26, 2008

(65) Prior Publication Data

US 2009/0142967 A1 Jun. 4, 2009

(30) Foreign Application Priority Data

Nov. 29, 2007 (JP) ..... 2007-309365

(51) Int. Cl.
*H01R 13/40* (2006.01)

(52) U.S. Cl. ..... 439/603

(58) Field of Classification Search ..... 439/660, 439/74, 71, 81, 83, 84, 65, 603, 874
See application file for complete search history.

(56) References Cited

U.S. PATENT DOCUMENTS 4,808,122 A 2/1989 Tomizu et al.
5,064,389 A * 11/1991 Klein et al. ..... 439/651
5,326,286 A 7/1994 Bixler et al.
5,564,949 A 10/1996 Wellinsky
6,152,782 A * 11/2000 Volkert et al. ..... 439/733.1
6,575,775 B2 * 6/2003 Hasegawa et al. ..... 439/188
6,764,314 B1 * 7/2004 Lee ..... 439/65
7,059,908 B2 * 6/2006 Yamaguchi ..... 439/607.17
7,125,293 B2 * 10/2006 Mongold et al. ..... 439/874
7,367,816 B2 * 5/2008 Liu ..... 439/74
2004/0023533 A1 2/2004 Sasame
2006/0030196 A1 2/2006 Sasame

* cited by examiner

*Primary Examiner*—Chandrika Prasad
(74) *Attorney, Agent, or Firm*—Barley Snyder LLC

(57) ABSTRACT

An electrical connecter capable of preventing a contact member from being lifted up without inhibiting reduction in height is provided. A contact member of an electrical connector, which is held in a housing including a press-fit hole and a support surface, and is to be connected to a mating contact member is provided. The contact member includes a flat contact portion for contact with the mating contact member, and is disposed along the support surface, a flat press-fit fixing portion, which is connected to the contact portion, and is press-fitted into the press-fit hole, a tine portion connected to the press-fit fixing portion, and a lug extending from a side surface of the press-fit fixing portion, and the lug includes a support piece and an inclined piece.

12 Claims, 15 Drawing Sheets

PRIOR ART

PRIOR ART

PRIOR ART

PRIOR ART

HOLDING STRUCTURE OF A CONTACT MEMBER FOR AN ELECTRICAL CONNECTOR

CROSS-REFERENCE TO RELATED APPLICATIONS

This application claims the benefit of the filing date under 35 U.S.C. §119(a)-(d) of Japanese Patent Application No. 2007-309365, filed Nov. 29, 2007.

FIELD OF THE INVENTION

The present invention relates to a contact member held in an insulated housing of an electrical connector and its holding structure, and particularly relates to a holding structure of a contact member suitable for a low profiled header, which is soldered to a printed wiring board.

BACKGROUND

Electrical connectors (hereinafter, simply called a connector) that interconnect printed wiring boards (hereinafter, simply called wiring boards), having electronic components mounted in a parallel, are commonly known in the art, especially when used inside electronic equipment such as the personal computer. These connectors are generally mounted on each of the wiring boards, and are sometimes known as vertical headers.

Japanese Utility Model Laid-Open No. 4-99378 discloses a high-density connector, which is a compact connecter having a number of contact members. As shown in FIG. 14, the connector 200 has a plurality of terminal plate mating portions 202 formed in the rear portion of a housing 201, and after terminal units 203 mate with the terminal plate mating portions 202, each of the terminal units 203 are then welded to the housing 201, rigidly connecting the two. In the terminal unit 203, a number of contact members 205 and 206 are embedded in a terminal plate 204. The terminal plate 204 being short in dimension along a longitudinal direction with a narrow width in two rows at predetermined pitches. Contact portions 205*a* and 206*a* of the contact members 205 and 206 are disposed in a mating recess 207, along insulated walls 208 formed in the mating recess 207 of the housing 201.

In the connector 200, projections 208*a* are formed at upper end portions of the insulated walls 208. In plan view, the contact portions 205*a* and 206*a* are hidden by the projections 208*a*. Specifically, the projections 208*a* are provided to prevent the contact members of a mating connector (not shown) from colliding with the tip ends of the contact portions 205*a* and 206*a* when the connector 200 mates with the mating connector. When the contact members of the mating connector collide with the tip ends of the contact portions 205*a* and 206*a*, mating may become insufficient. Alternatively, the contact portions 205*a* and 206*a* and even the contact members of the mating connector may be damaged.

With the miniaturization of electrical equipment, the connector 200 is required to be of a reduced height, that is, to reduce its height in correspondence with size of electronic equipment. However, it is not advantageous to minimize the height of the connector 200, in which the projections 208*a* are provided at the tip ends of the insulated walls 208, because the insulated walls 208 become higher correspondingly to formation of the projections 208*a*.

As shown in FIG. 15, a connector 300 described in Japanese Patent Laid-Open No. 2001-102120 is not provided with the projections at the upper ends of the insulated walls, as described in the Japanese Utility Model Laid-Open No. 4-99378 connector 200, and therefore, the connector 300 can be reduced in height.

Incidentally, a contact member 303 is only restrained to a housing 301 by press-fitting its raised portion into a bottom floor 301*b*. Accordingly, when a force is applied to a tine portion 303*b* of the contact member 303 in the direction shown by an arrow, the contact member 303 rotates in the direction shown by an arrow around the press-fitted portion. Thereupon, a contact portion 303*a* displaces in the direction away from an insulated wall 302. Thereupon, the contact portion 303*a* is likely to collide with a contact portion 304*a* of a contact member 304 of a mating connector. Hereinafter, displacement of the contact portion 303*a* in the direction to be away from the insulated wall 302 will be called "lift" of the contact portion.

When the thickness of the bottom floor 301*b* of the housing 301 becomes thin, the contact member 303 may easily rotate when a force is applied to the tine portion 303*b* in the direction shown by the arrow. This is because the length of the bottom floor 301*b*, which restrains the contact member 303, becomes short. When the connector 300 is reduced in height, a predetermined mating length needs to be measured. Therefore, the thickness of the bottom floor 301*b* is made thin. Accordingly, when the connector 300 is reduced in height, the contact portion 303*a* is easily lifted from the insulated wall 302.

SUMMARY

The present invention is made in view of the technical problem described above, and it is an object of the present invention to provide a contact member capable of preventing a contact portion from being lifted from an insulated wall of a housing, without inhibiting reduction in height.

It is further an object of the invention to provide a holding structure of the contact member and a connector, which prevent the contact portion from being lifted from the insulated wall by using the contact member. The contact member, of the present invention, comprising a contact member of a connector, which is held in a housing having a press-fitting hole and a support surface, and is connected to a mating contact member. The contact member further comprising a flat contact portion in order to mate with the mating contact member, and disposed along the support surface, a flat press-fit fixing portion that is connected to the contact portion and is press-fitted into the press-fit hole, a tine portion connected to the press-fit fixing portion, and a lug extending from a side surface of the press-fit fixing portion, wherein the lug includes a inclined piece projected to the support surface side from the contact portion, and the projected portion is disposed at a side opposite from the contact portion with respect to the press-fit fixing portion.

BRIEF DESCRIPTION OF THE DRAWINGS

The invention will be explained in greater detail in the following with reference to embodiments, referring to the appended drawings, in which:

FIG. 7A shows a front view, FIG. 7B shows a side view and FIG. 7*e* shows a plan view;

FIG. 8A shows a front view, FIG. 8B shows a side view, and FIG. 8*e* shows a plan view;

FIG. 13A shows a front view, and FIG. 13B shows a side view;

DETAILED DESCRIPTION OF THE EMBODIMENT(S)

Hereinafter, a preferred embodiment of a connector, according to the present invention, will be described in detail with reference to the accompanying drawings. The present embodiment is an example in which the present invention is applied to a docking connector, which connects a notebook type personal computer (hereinafter, called a note PC) and a docking station, which is an extension unit, to each other.

Figure 1:
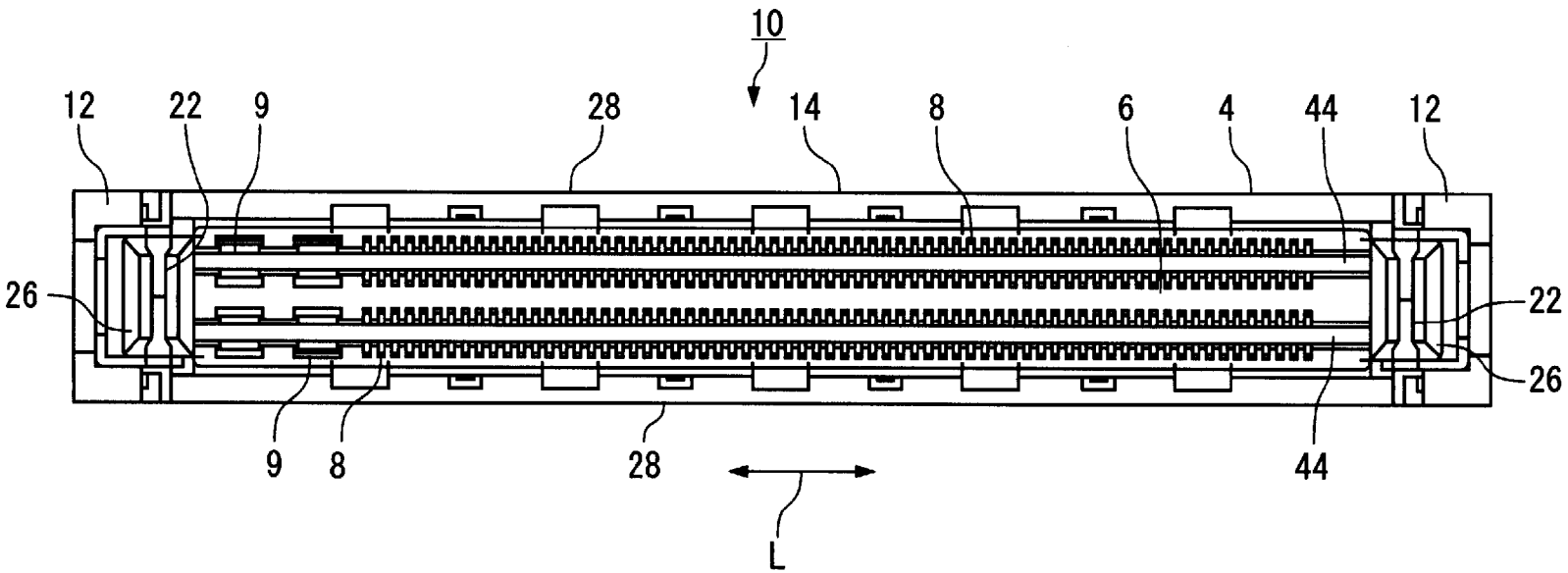
FIG. 1 is a plan view of a plug connector according to the present embodiment.
Figure 2:
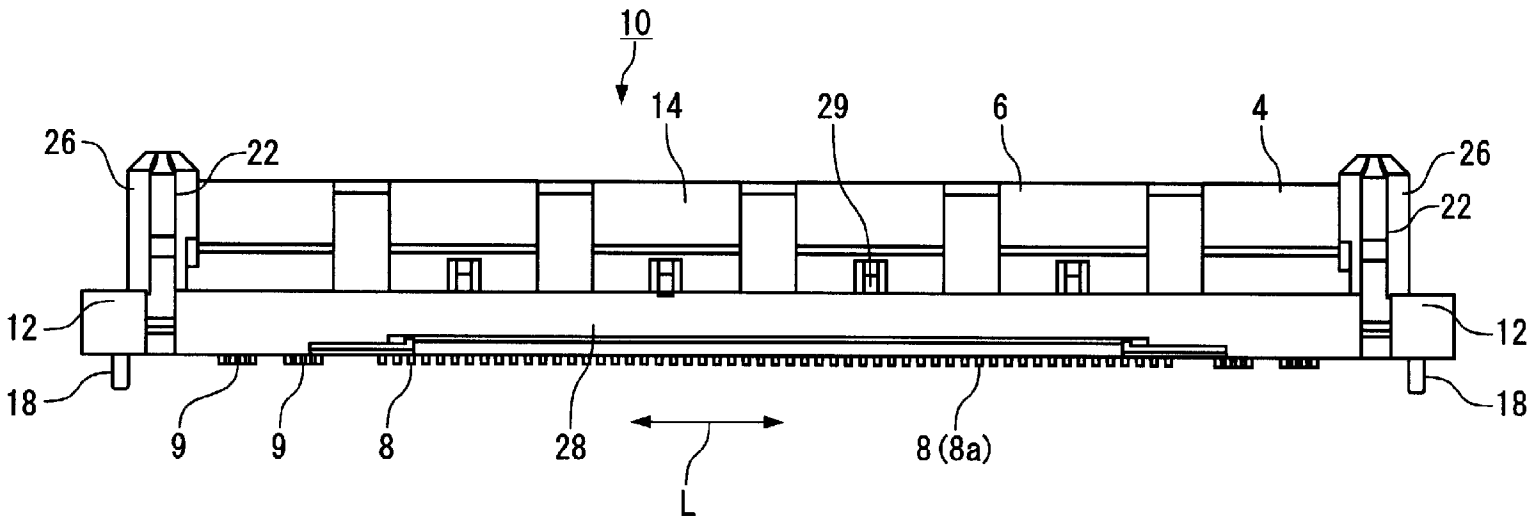
FIG. 2 is a front view of the plug connector of FIG. 1.
Figure 3:
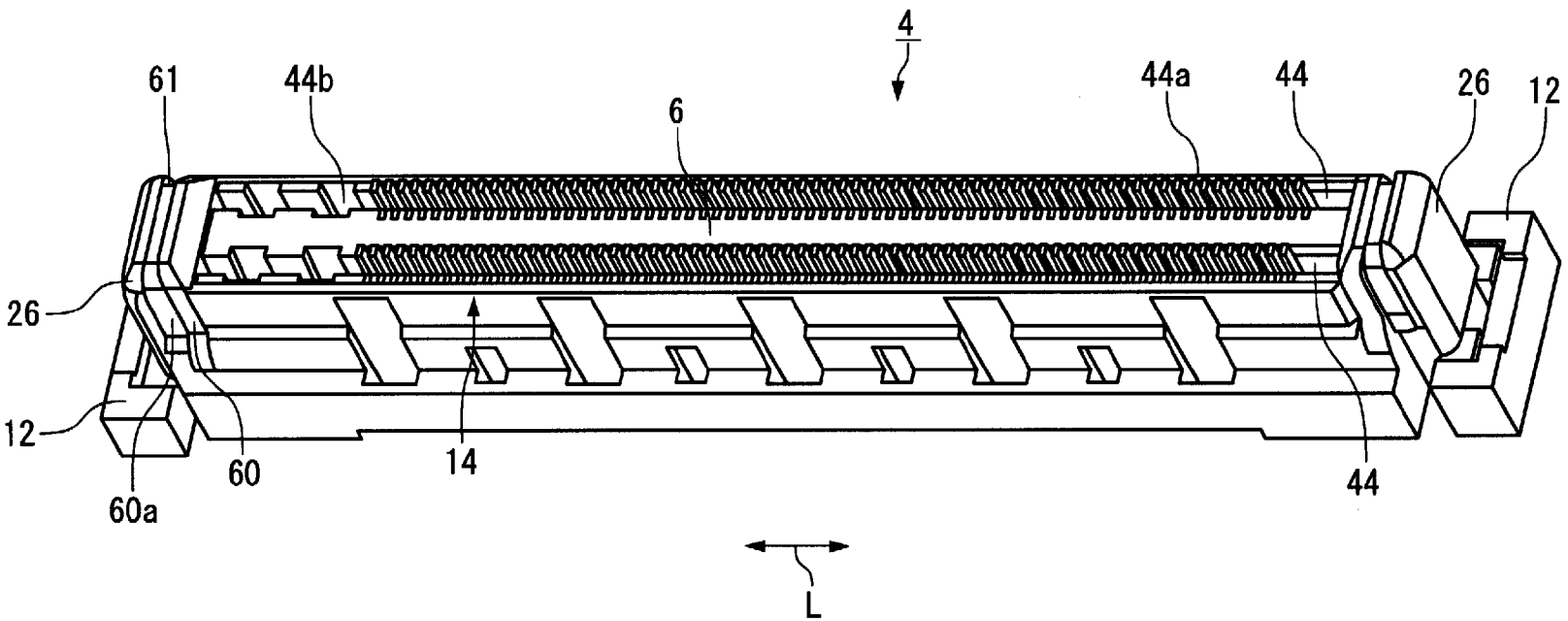
FIG. 3 is a perspective view of a housing constituting the plug connector of FIG. 1.

FIGS. 1 to 3 show a plug connector 10 of the present embodiment. FIG. 1 is a plan view of the plug connector 10, FIG. 2 is a front view, and FIG. 3 is a perspective view of a housing 4, constituting the plug connector 10. The plug connector 10 is placed on a top surface of the docking station.

In FIGS. 1 to 3, the plug connector 10 has an elongated insulated housing 4, and contact members 8 and 9, which are held in a mating portion 6 of the housing 4. The contact members 8 and 9 are formed in four rows along a longitudinal direction L of the housing 4.

The contact member 8 has a narrow width that is advantageous for signal transmission, while the contact member 9 has a larger width that is advantageous for power supply.

The housing 4 has a main body 14, formed in a rectangular parallelepiped shape, extending in the longitudinal direction L. The housing 4 has mounting portions 12, also formed in a rectangular parallelepiped shape, which are located at both ends of the housing 4. The main body 14 and the mounting portions 12 are integrally molded from a synthetic resin, in the preferred embodiment.

Each of the mounting portions 12 are mounted with a holding metal fitting 22. Each holding metal fitting 22 has a holding leg 18, which extends to the side of a wiring board on which the plug connector 10 is mounted. The holding leg 18 is used when the plug connector 10 is mounted on the wiring board.

The plug connector 10 further comprises guide posts 26, which are inserted into guide holes 118 of a receptacle connector 100. The guide posts 26, which will be described in greater detail below, are provided at both ends of the mating portion 6, projecting in the mating direction. The guide posts 26 serve as guide and lock functions.

The housing 4 is mounted with shield shells (hereinafter, simply called shells) 28. Each shell 28 is formed by being stamped out of one metal sheet and bent.

Additionally, the housing 4 includes mating grooves 44 in the mating portion 6 of the housing 4. The mating grooves are formed in two rows, along the longitudinal direction L, and a plurality of contact receiving grooves 44*a* and 44*b* are formed at both sides of the mating groove 44. The contact receiving grooves 44*a* and 44*b* are respectively formed in accordance with the widths of the contact members 8 and 9. The contact members 8 are disposed in the contact receiving groove 44*a*, and the contact members 9 are disposed in the contact receiving groove 44*b*.

Next, the mating receptacle connector 100, which mates with the plug connector 10, will be described in greater detail with reference to FIGS. 4 to 6.

Figure 4:
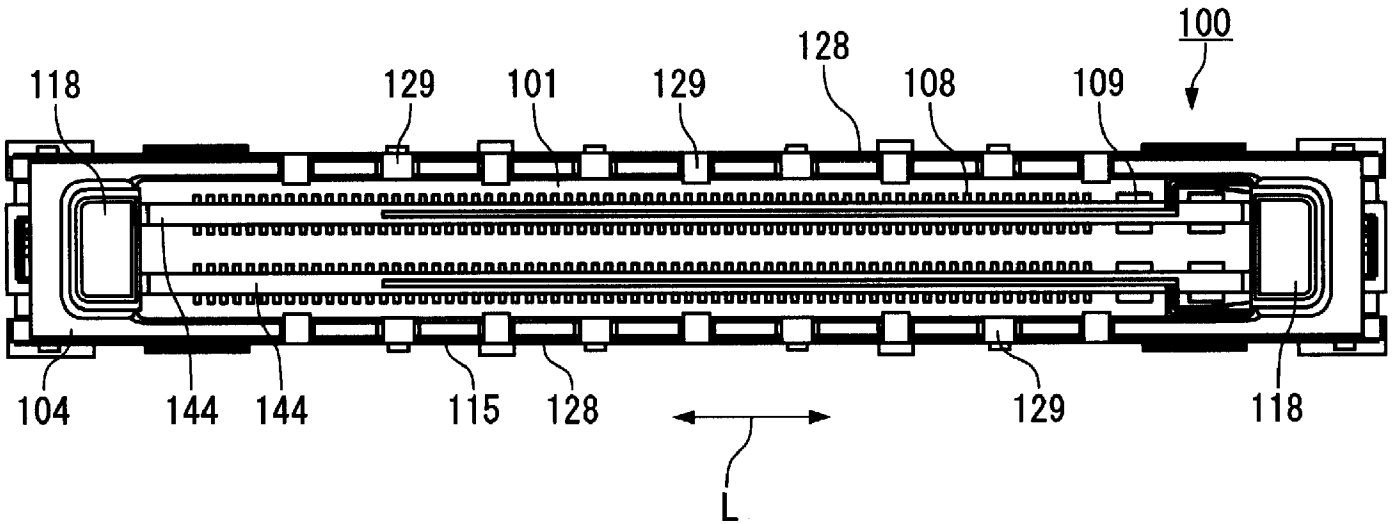
FIG. 4 is a plan view of a receptacle connector which mates with the plug connector of FIG. 1.
Figure 5:
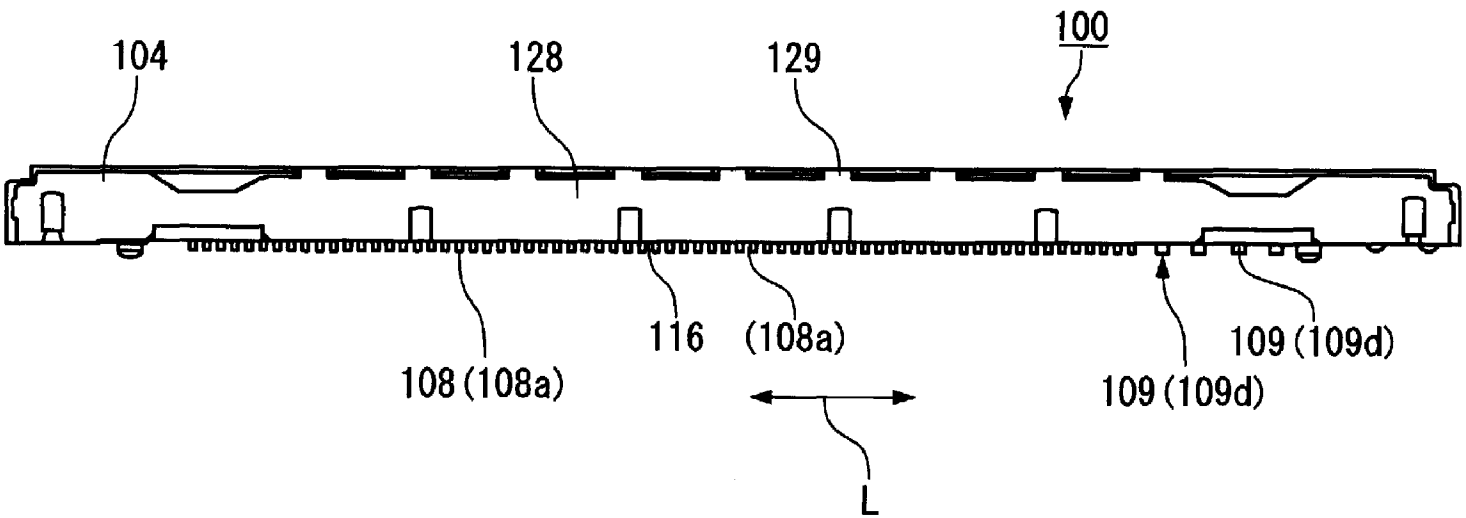
FIG. 5 is a front view of the receptacle connector of FIG. 4.
Figure 6:
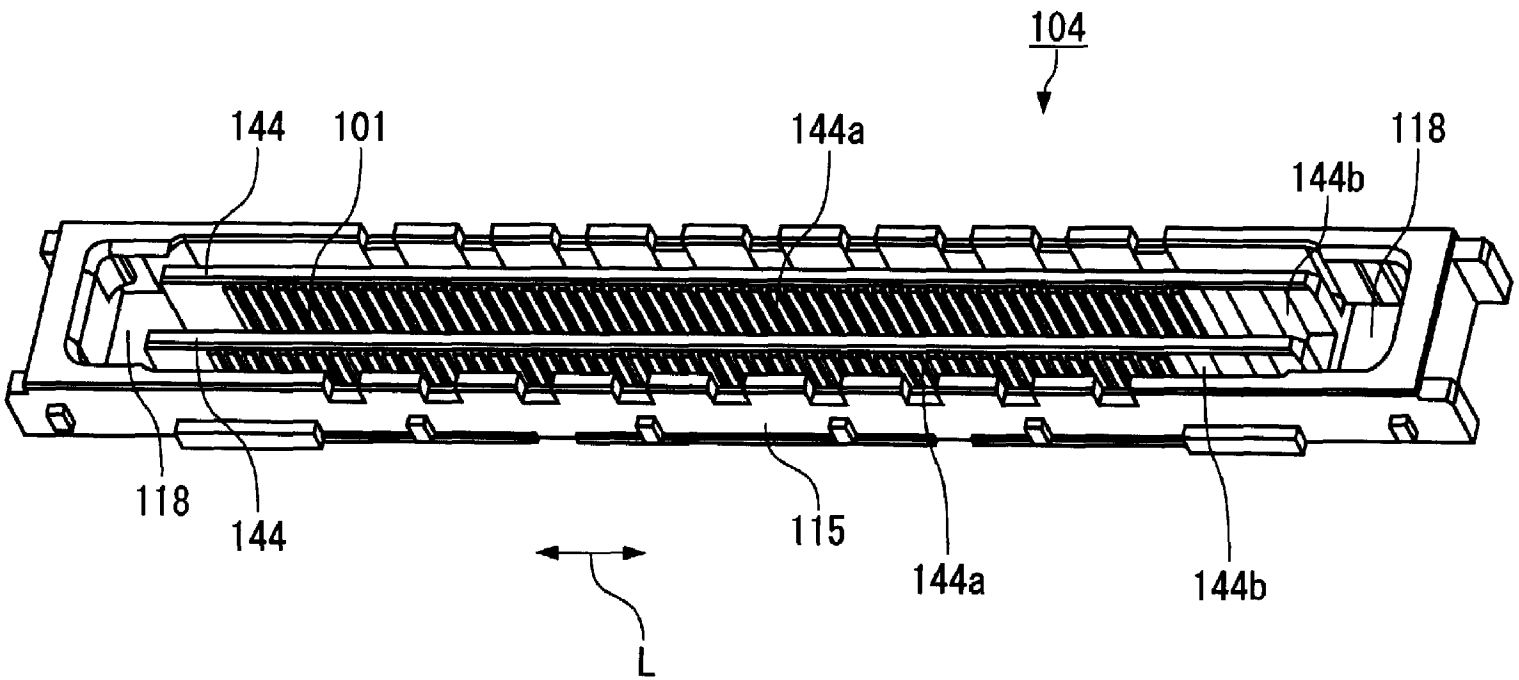
FIG. 6 is a perspective view of a housing constituting the receptacle connector of FIG. 4.

FIG. 4 is a plan view of the receptacle connector 100, FIG. 5 is a front view of it, and FIG. 6 is a perspective view of a housing 104 of the receptacle connector 100. The receptacle connector 100 is placed on the bottom surface of a note pc.

The receptacle connector 100 includes an insulated housing 104, formed in a rectangular parallelepiped shape, a shield shell (hereinafter, simply called a shell) 128 made of a metal and formed to cover a side wall 115 of the housing 104, and a plurality of contact members 108 and 109 held in the housing 104. The contact members 108 and 109 are respectively connected to the contact members 8 and 9 of the plug connector 10.

In the housing 104, a mating recess 101 extending along the longitudinal direction L is formed. In the mating recess 101, mating ribs 144 are formed in two rows, which mate with the mating grooves 44 of the plug connector 10 when connected. The mating ribs 144 are integrally constructed with the housing 104, along the longitudinal direction L. On the side surface of the mating rib 144, a plurality of contact receiving grooves 144*a* and 144*b* are formed. The contact receiving grooves 144*a* and 144*b* are respectively formed in accordance with the width of the contact members 108 and 109.

The contact members 108 are disposed in the contact receiving groove 144*a*, and the contact members 109 are disposed in the contact receiving groove 144*b*. The contact members 108 and 109 are disposed in the contact receiving grooves 144*a* and 144*b*, and are placed in rows at both sides of each of the mating ribs 144.

Guide holes 118, for receiving the guide posts 26 of the plug connector 10, are formed at both end portions in the longitudinal direction L of the housing 104.

The contact members 108 and 109 have tine portions 108*a* and 109*c* which are respectively connected to wiring boards (not shown), and the tine portions 108*a* and 109*c* are exposed from the undersurface of the housing 104.

When the plug connector 10 and the receptacle connector 100 are mated with each other, the contact members 8 and the contact members 108 are connected, and the contact members 9 and the contact members 109 are connected.

In the present embodiment the shape of the contact member 109 prevents the contact portion 109*a* from being lifted from the insulative wall without inhibiting reduction in height of the docking connector constituted of the plug connector 10 and the receptacle connector 100. Here, the contact member 109 is taken as an example, but it goes without saying that the present invention can be applied to the contact members 8 and 9 and 108.

Figure 7A:
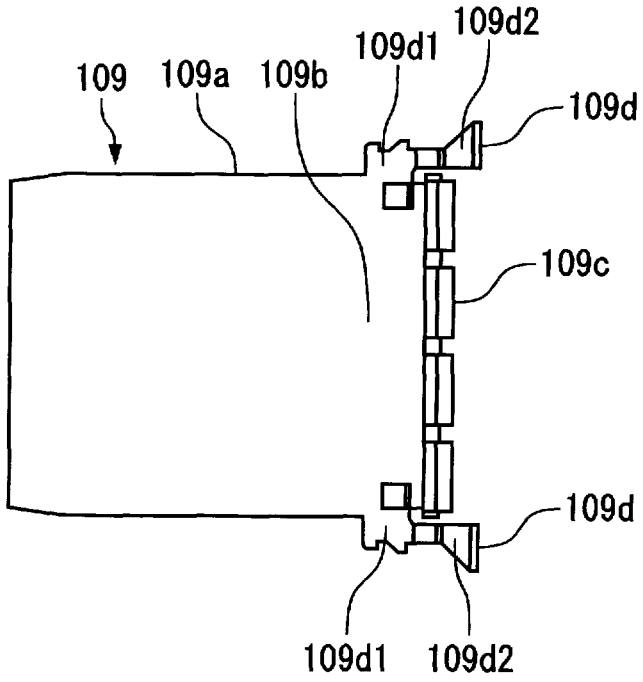
FIGS. 7A to 7C are views showing a contact member used in the plug connector of FIG. 1.
Figure 7B:
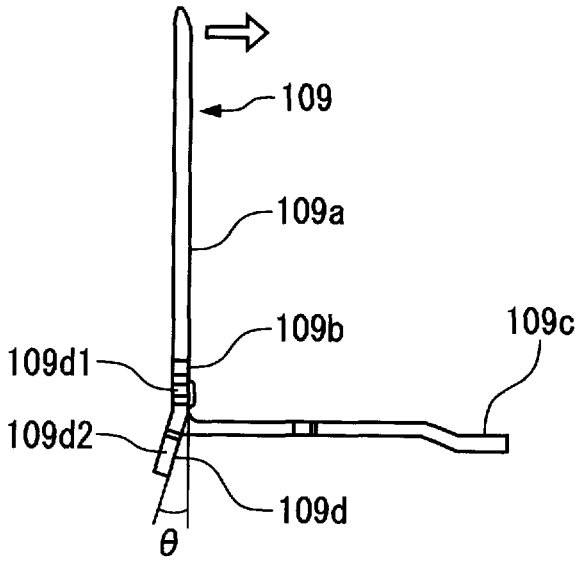
Figure 7C:
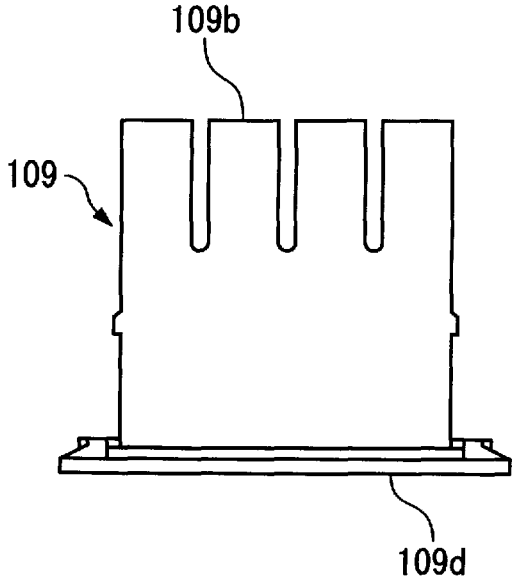

FIGS. 7A to 7C are views showing the contact member 109, FIG. 7A shows a front view, FIG. 7B shows a side view, and FIG. 7C shows a plan view.

The contact member 109 is L-shaped in the vertical section, and comprises a contact portion 109*a*, a press-fit fixing portion 109*b*, a tine portion 109*c*, and lugs 109*d*. In the contact member 109, by stamping out and bending a thin metal plate with a high electric conductivity such as a copper alloy, for example, the contact portion 109*a*, the press-fit fixing portion 109*b*, the tine portion 109*c* and the lugs 109*d* are integrally formed. The contact member 109 is made of a thin metal plate, and therefore, each of the components has resiliency.

The contact portion 109*a* is the region for contact with the contact member 9 of the mating connector. Here, a free end side of the contact portion 109*a* will be called a front end, and a side connecting to the tine portion 109*c* will be called a rear end. The contact portion 109*a* is connected at the rear end to the press-fit fixing portion 109*b*, which is press-fitted into a bottom floor 116 of the housing 104. The contact portion 109*a* is received by the contact receiving groove 144*b* of the housing 104.

The tine portion 109*c* is electrically connected to a wiring board (not shown) mounted with the receptacle connector 100. The tine portion 109*c* has its one end connected to the press-fit fixing portion 109*b*. Further, the tine portion 109*c* forms an angle of about 90° with respect to the contact portion 109*a*.

The above contact portion 109*a*, press-fit fixing portion 109*b* and the tine portion 109*c* are similar to the respective portions of a known contact.

The lugs 109*d* are provided at both side surfaces, opposed to the width direction of the press-fit fixing portion 109*b*. The lug 109*d* comprises a support piece 109*d*1, extending from a side surface of the contact portion 109*a*, and an inclined piece 109*d*2, which is connected to the support piece 109*d*1 extending toward the rear end. The support piece 109*d*1 is provided on the same plane as the contact portion 109*a*. The inclined piece 109*d*2 is provided to form a predetermined angle e with respect to the support piece 109*d*1, and with respect to the contact portion 109*a*. The inclined piece 109*d*2 has elasticity, and functions as a spring. The contact portion 109*a* is integrally constructed with the lugs 109*d*. Further, the inclined pieces 109*d*2 are disposed at the opposite side from the contact portion 109*a* with respect to the press-fit fixing portion 109*b*.

Figure 8A:
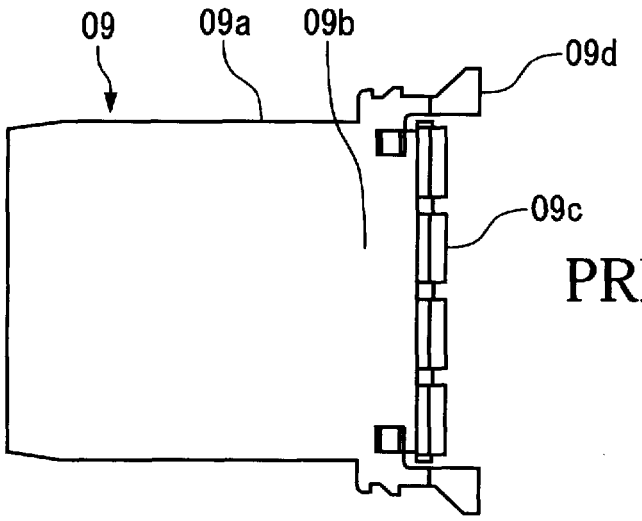
FIGS. 8A to 8C are views showing a conventional contact member.
Figure 8B:
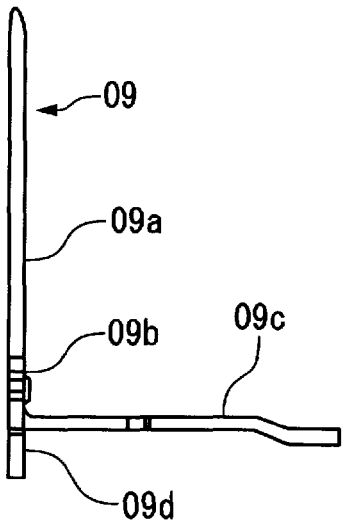
PRIOR ART FIG. 8B
Figure 8C:
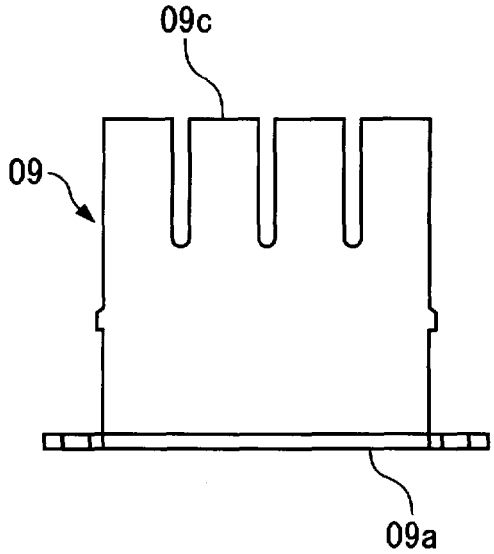
PRIOR ART FIG. 8C

FIGS. 8A to 8*e* are views showing a conventional contact member 09 known to the art, FIG. 8A shows a front view, FIG. 8B shows a side view and FIG. 8*e* shows a plan view.

The components corresponding to the contact portion 109*a*, the tine portion 109*c* and the lug 109*d* of the contact member 109 of the present invention, are assigned with reference numerals and characters 09*a*, 09*b* and 09*c*, respectively.

The conventional contact member 09 differs from the contact member 109 of the present invention, in that the entire lug 09*d* is provided on the same plane as the contact portion 09*a*. The contact member 109 is inserted into the housing 104 in the direction of the solid line arrow.

Figure 9:
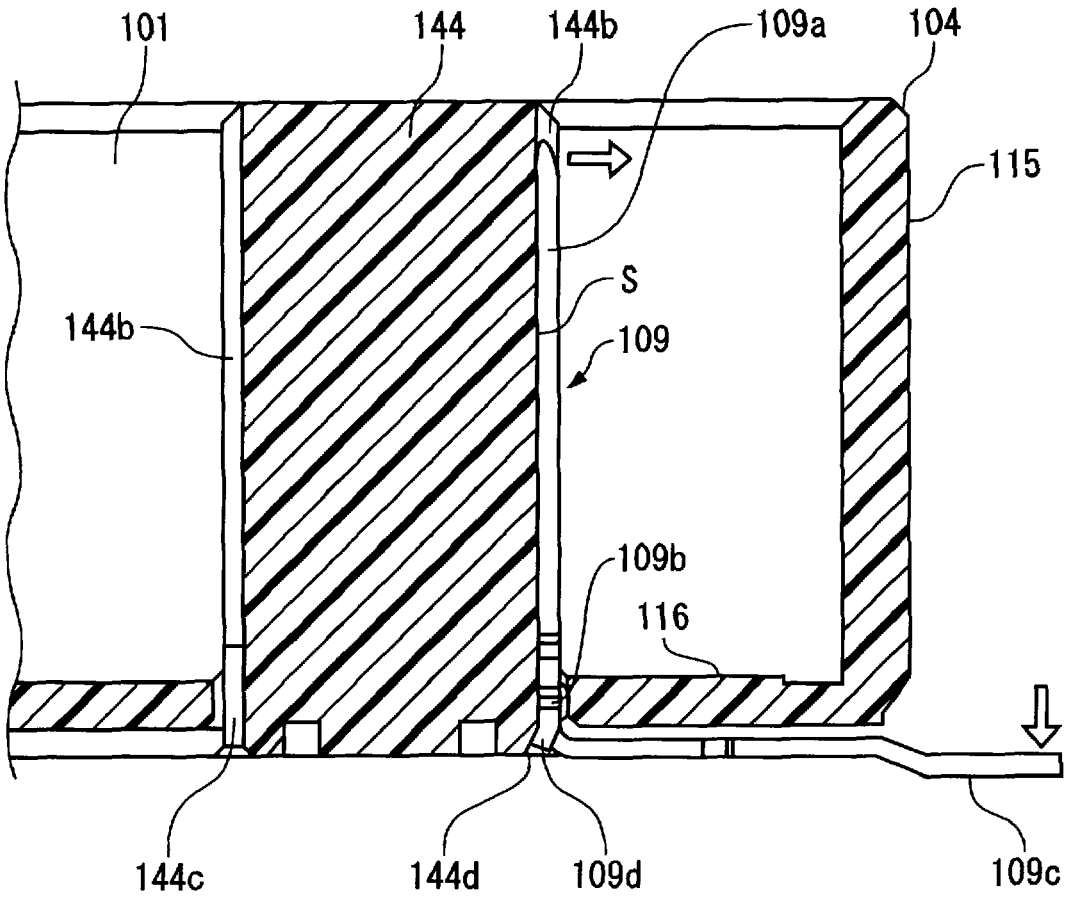
FIG. 9 is a partial sectional view showing the state in which the contact member, according to the present invention, is held in the housing of the receptacle connector.

FIG. 9 is a partial sectional view showing the state in which the contact member 109, of the present invention, is held in the housing 104 of the receptacle connector 100. The contact member 109 is press-fitted into the housing 104 from below in FIG. 9.

The contact portion 109*a* of the contact member 109 is received in the contact receiving groove 144*a*, which is formed in the mating rib 144. Further, the press-fit fixing portion 109*b* of the contact member 109 is press-fitted into a press-fit hole 144*c*, which is formed in the bottom floor 116 of the housing 104. The contact member 109 is restrained by the housing 104 by only the press-fit fixing portion 109*b*.

The lugs 109*d* are located at both ends in the width direction of the press-fit hole 144*c*. Meanwhile, pressing surfaces 144*d* formed on the same plane as the support surface S are formed at the positions corresponding to the lugs 109*d*.

A force is assumed to be applied to the tine portion 109*c* of the contact member 109 in the direction of the outlined arrow. The contact member 109 is restrained by the housing 104 by only the press-fit fixing portion 109*b*, and therefore, the contact member 109 is to rotate in the direction shown by the outlined arrow with the press-fit fixing portion 109*b* as a center. However, the inclined pieces 109*d*2 of the lugs 109*d* are projected to the support surface S side from the contact portion 109*a*, and therefore, are pressed by the pressing surfaces 144*d* in the press-fit hole 144*c*. Since the contact portion 109*a* is formed integrally with the inclined pieces 109*d*2 via the press-fit fixing portion 109*b*, a force pressing to the support surface S is applied to the contact portion 109*a* as shown by the outlined arrow. This force prevents the contact portion 109*a* from being lifted from the support surface S.

Figure 10:
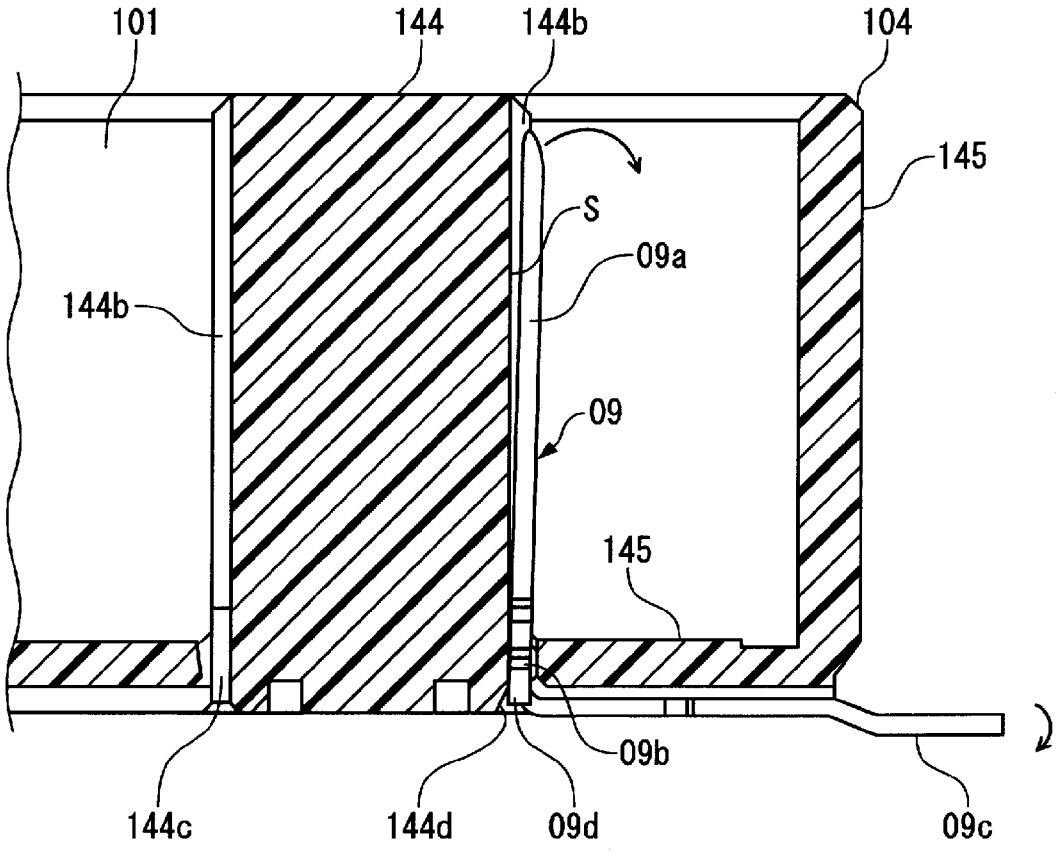
FIG. 10 is a partial sectional view showing the state in which the conventional contact member is held in the housing of the receptacle connector.

FIG. 10 is a view in which the contact member 109 of FIG. 9 is replaced with the conventional contact member 09.

In reference to the conventional contact member 09, the lugs 09*d* are disposed parallel along the support surface S. Accordingly, when a force is applied to the tine portion 09*c* in the arrow direction, the contact portion 09*a* rotates, in the arrow direction, with the press-fit fixing portion 09*b* as the center of rotation. As a result, the contact portion 09*a* is lifted from the support surface S.

In contradistinction, and according to the present embodiment, even if a force is applied to the tine portion 109*c* of the contact member 109 in the direction of the arrow shown in FIG. 9, the inclined pieces 109*d*2 are pressed by the pressing surfaces 144*d*, whereby a force that presses the contact portion 109*a* against the support surface S occurs. Therefore, the contact portion 109*a* is not lifted from the support surface S.

As described above, the contact member 109 can prevent the contact portion 109*a* from being lifted from the support surface S, whereby the contact member 109 is held in the housing 104 by the lugs 109*d*. The lugs 109*d* generate a resulting force that presses the contact portion 109*a* to the support surface S of the mating rib 144, such that the mating rib 144 becomes substantially integral with the contact portion 109*a*. The effect of the resulting force can be obtained without making the bottom floor 116 of the housing 104 thick.

Further, the present embodiment has the advantage of being capable of preventing the contact portion 109*a* from being lifted from the support surface S by only forming the inclined pieces 109*d*2 at part of the lugs 109*d*, without adding a new member. Hereinafter, this point will be described with reference to FIG. 11.

Figure 11:
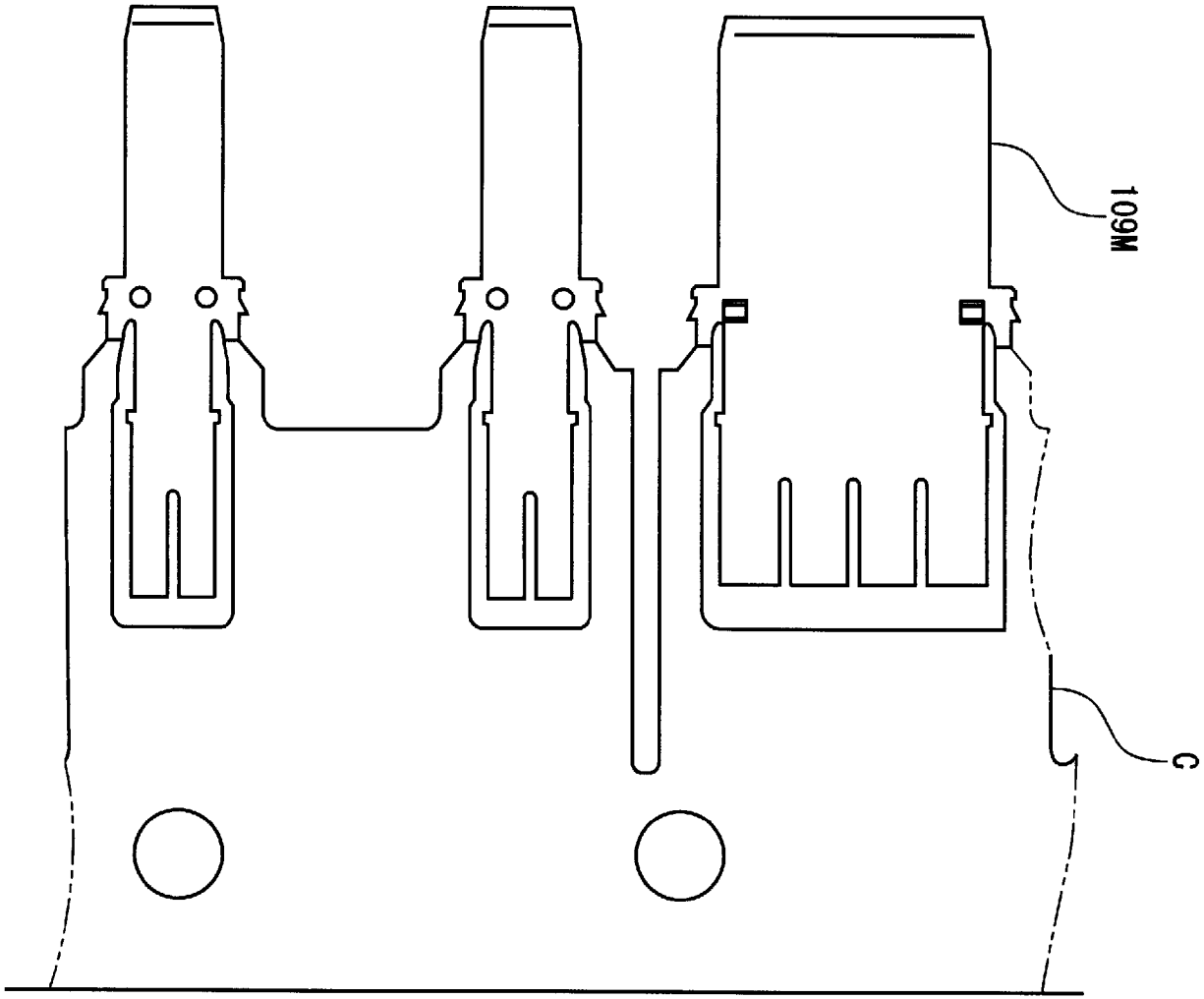
FIG. 11 is a view showing the state of the contact members in the manufacturing process.

FIG. 11 is a view showing the state of the contact member 109 in the manufacturing process, and shows the state in which an intermediate body 109M of the contact member 109 is formed by stamping out a thin metal plate. FIG. 11 also shows the example in which the intermediate bodies of another kind of contact member are simultaneously formed.

In the intermediate body 109M, the portions corresponding to the lugs 109*d* of the contact member 109 are connected to a carrier C via a notch portion, and the contact member 109 is finally cut off from the carrier C by being cut at a predetermined position. The notch portion, is a portion that is formed to have a narrow width, capable of being easily cut off or broken off from the carrier C. Bending of the tine portion

109*c*, and the inclined pieces 109*d*2, is performed either before or after cutting the carrier C, and the inclined pieces 109*d*2 can be bent simultaneously with the tine portion 109*c*.

By simultaneously forming the intermediate body 109M of the contact member 109 and the intermediate bodies of another kind of contact member, in such a way that they are connected to the carrier C, the intermediate bodies of either kind of contact member can be handled together. Therefore, the various contact members can be stamped out together, and further preparation of the contact members, such as bending, can be applied, whereby high and efficient productivity can be attained. The lugs 109*d* are formed from the notch portion connecting the carrier C, as well as the intermediate body 109M of the contact member 109, when the manufacturing method described above is adopted. Therefore, according to the present embodiment, the advantages associated with the lugs 109*d*, which prevent the contact portion 109*a* from being lifted from the support surface S, are provided without an increase in cost.

Figure 12:
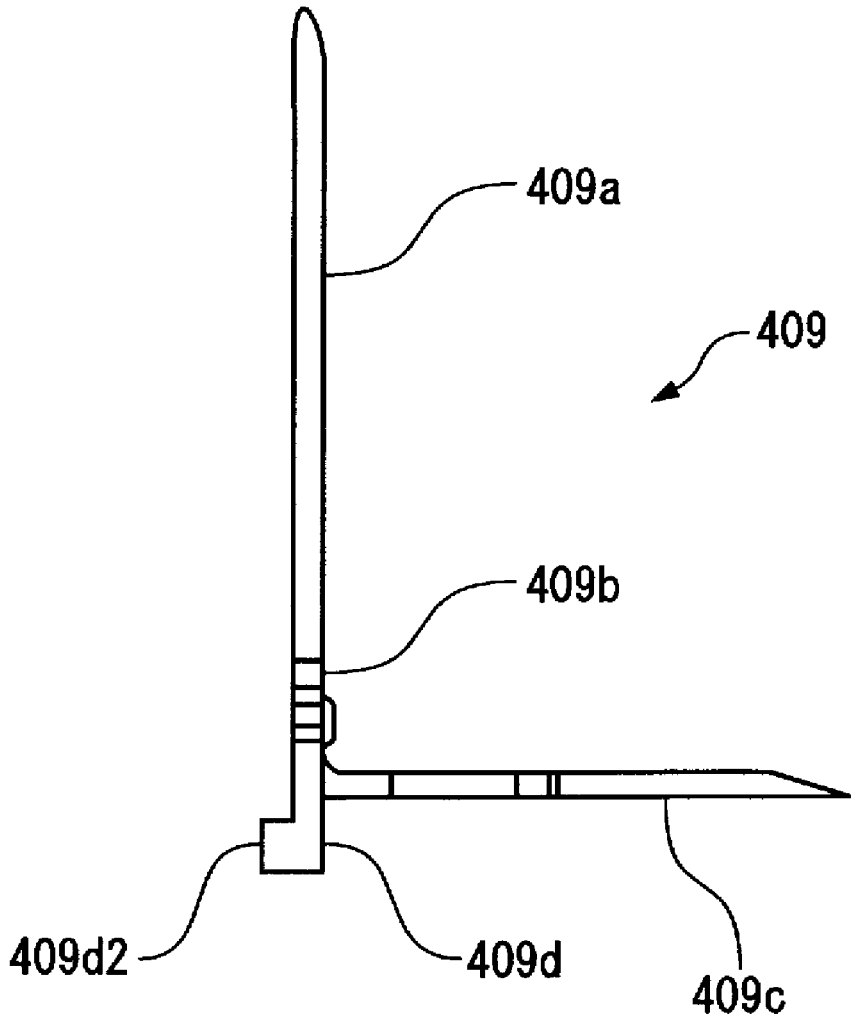
FIG. 12 is a view showing another example of the contact member according to the present invention.

In the above, the inclined pieces 109*d*2 are provided in the lugs 109*d*, but other constitutions can be adopted as long as they exhibit similar functions. For example, instead of the inclined piece 109*d*2, a projection can be provided. FIG. 12 shows an example of it. A contact member 409 includes a press-fit fixing portion 409*b* and a tine portion 409*c*, and a lug 409*d* is formed on the same plane as the contact portion 409*a*, but a projection 409*d*2 projected to the support surface S side of the mating rib 144 is formed at a tip end of the lug 409*d*.

Figure 13A:
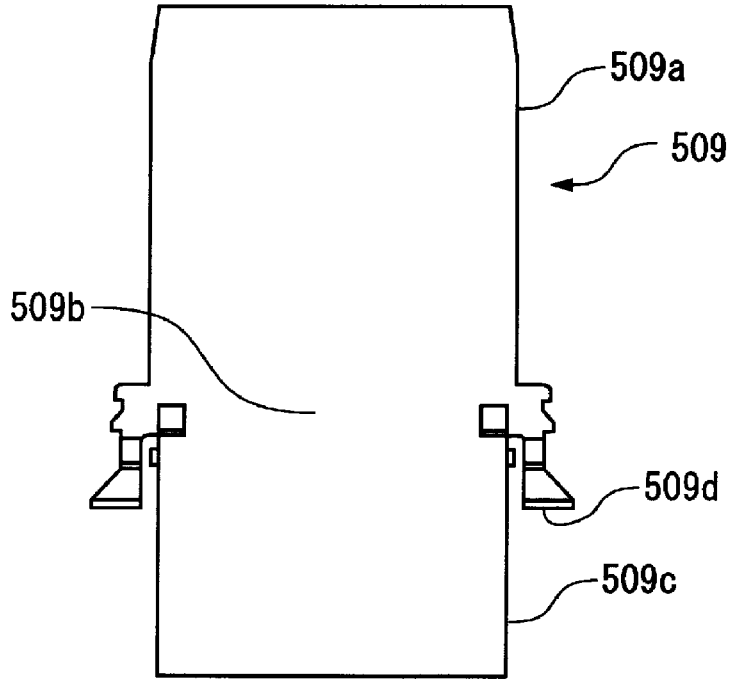
FIGS. 13A and 13B are views showing another example of the contact member according to the present invention.
Figure 13B:
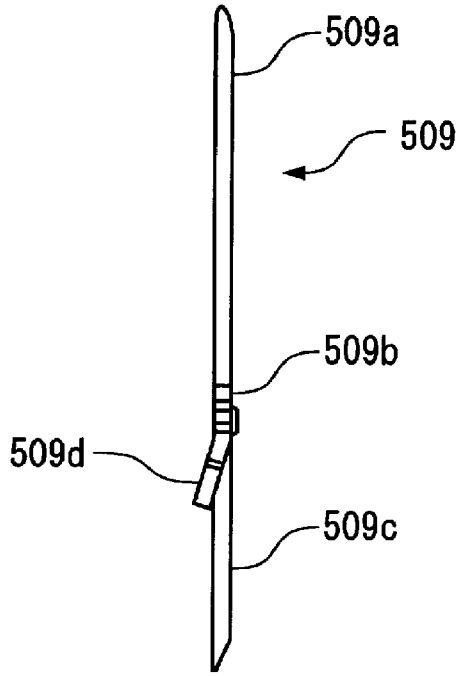
Figure 14:
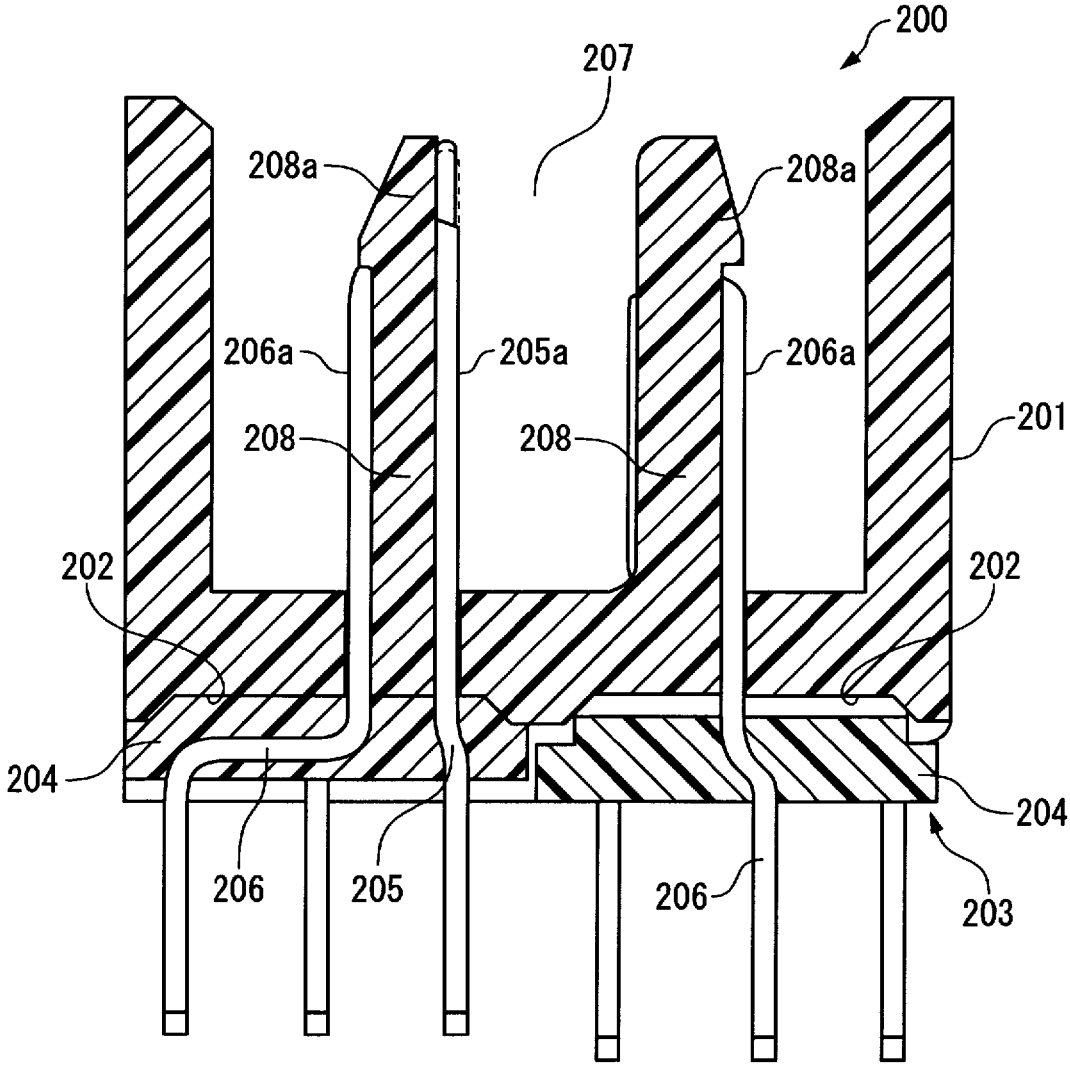
FIG. 14 is a perspective view showing the connector disclosed in Japanese Utility Model Laid-Open No. 499378.
Figure 15:
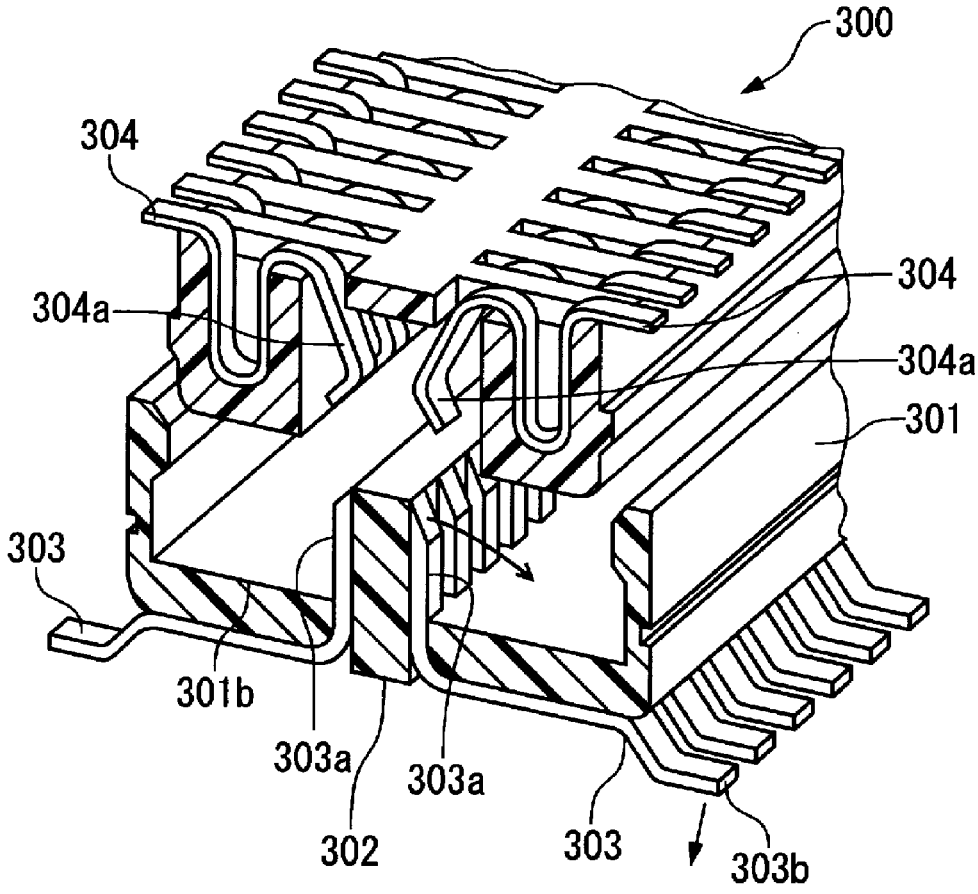
FIG. 15 is a perspective view showing the connector disclosed in Japanese Patent Laid-Open No. 2001-102120.

The L-shaped contact member 109 is not limited to the particular embodiment described above. For example, as shown in FIG. 13, the present invention may feature another embodiment of a contact member 509 comprising a contact portion 509*a*, a press-fit fixing portion 509*b*, a tine portion 509*c* and lugs 509*d*, and as a whole is formed in a flat I-shape. In the contact member 509, the lug 509*d* has a similar constitution and function as the lug 109*d*, described above. The L-shaped contact member 109 may be used with a surface mounting connector, whereas the lshaped contact member 509 may be used with a connector that is mounted to a circuit board, with a through-hole being formed.

Further, as shown in FIGS. 7A and 7B, the inclined pieces 109*d*2 are formed on both sides of the contact member 109. It is possible, according to the invention, to form the inclined piece 109*d*2 only on one side of the contact member 109. However, when the width of the contact portion 109*a* is wide, it becomes difficult to exert the force necessary to press the contact portion 109*a* against the mating rib 144 on the entire area, in the width direction, of the contact portion 109*a*, if the inclined piece 109*d*2 is only formed on one side of the contact member 109. Accordingly, one embodiment, of the present invention, having the inclined piece 109*d*2, only on one side of the contact member 109, may be best applied in the case where the width of the contact portion 109*a* is relatively narrow.

In addition to the above, it is possible to adopt, omit and select the constitutions cited in the above described embodiment, or properly change the constitutions to other constitutions as long as they do not depart from the gist of the present invention, that is, the gist that the lug generates the necessary force to presses flat the contact portion to the support surface, so that support surface integrally forms with the contact portion.

The lug 109*d* in the contact member 109 of the present invention may formed as any shape, as long as the lug 109*d* includes a support piece 109*d*1 that is connected to the press-fit fixing portion 109*b*, and is provided on the same plane as the contact portion 109*a* and an inclined piece 109*d*2 that is extended from the support piece 109*d*1 in a direction in which the mating contact member 109 is inserted, with a tip end of it being inclined to be close to the support surface S. The lug 109*d* of the contact member 109 can be formed without adding a new process step, in the process of manufacturing the contact member 109.

Further, the lugs 109*d* are preferably provided at both side surfaces in a width direction of the press-fit fixing portion 109*b*. This is because the contact portion 109*a* can be more reliably pressed to the support surface S.

The present invention provides a holding structure of a contact member 109 using the above contact member 109. More specifically, the present invention provides a holding structure of a contact member 109 with respect to a housing 104, in which a press-fit fixing portion 109*b* is press-fitted into a press-fit hole 144*c* formed in the housing 104, and a contact portion 109*a* is disposed along a support surface S formed in the housing 104, and is characterized in that the contact member 109 includes the flat contact portion 109*a* that is in contact with a mating contact member 109, and is disposed along the support surface S, a flat press-fit fixing portion 109*b* that is connected to the contact portion 109*a* and press-fitted into the press-fit hole 144*c*, a tine portion 109*c* connected to the press-fit fixing portion 109*b*, and a lug 109*d* extending from a side surface of the press-fit fixing portion 109*b*, the lug 109*d* includes a inclined piece 109*d*2 projected to the support surface S side from the contact portion 109*a*, and the inclined piece 109*d*2 is disposed at a side opposite from the contact portion 109*a* with respect to the press-fit fixing portion. The housing 104 is characterized by including a pressing surface 144*d*, which presses the inclined piece 109*d*2 of the lug 109*d*.

In the above holding structure of the contact member 109, the lug 109*d* preferably includes a support piece 109*d*1, which is connected to the press-fit fixing portion 109*b* and is provided on the same plane as the contact portion 109*a*, and an inclined piece 109*d*2 that is extended from the support piece 109*d*1 in a direction in which the mating contact member 109 is inserted, with a tip end of it being inclined to be close to the support surface S. In the holding structure, the tip end of the inclined piece 109*d*2 is pressed by the pressing surface S.

Further, in the above holding structure of the contact member 109, the lugs 109*d* are preferably formed on both side surfaces, in a width direction of the press-fit fixing portion 109*b*, and in this case, the pressing surfaces are provided at both sides in a width direction of the press-fit hole 144*c*.

The present invention provides an electrical connector using the above contact member 109. The electrical connector comprises a first connector, such as a plug connector 10, mounted on a first printed wiring board, and a second connector, such as receptacle connector 100, mating with the first connector and mounted on a second printed wiring board. Anyone of the first connector and the second connector includes a housing including a press-fit hole 144*c* and a support surface S, and a plurality of contact members 108, 109 held in the housing, at least one of the contact members includes a flat contact portion 109*a* that is in contact with a mating contact member 108, and is disposed along the support surface S, a flat press-fit fixing portion 109*b* that is connected to the contact portion 109*a* and press-fitted into the press-fit hole 144*c*, a tine portion 109*c* connected to the press-fit fixing portion 109*b*, and a lug 109*d* extending from a side surface of the press-fit fixing portion 109*b*, the lug 109*d* includes a inclined piece 109*d*2 projected to the support surface S side from the contact portion 109*a*, and the inclined piece 109*d*2 is disposed at a side opposite from the contact portion 109*a* with respect to the press-fit fixing portion 109*b*. The housing is characterized by including a pressing surface, which presses the inclined piece 109*d*2 of the lug.

In the above connector, the lug 109*d* also preferably includes a support piece 109*d*1 that is connected to the press-fit fixing portion 109*b* and is provided on the same plane as the contact portion, and an inclined piece 109*d*2 which is extended from the support piece 109*d*1 in a direction in which the mating contact member 108 is inserted, with a tip end of it being inclined to be close to the support surface S, and the tip end of the inclined piece 109*d*2 is pressed by the pressing surface. Further, in the above connector, the lugs 109*d* are preferably provided at both side surfaces in a width direction of the press-fit fixing portion 109*b*, and in this case, the pressing surfaces are provided at both sides in a width direction of the press-fit hole 144*c*.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A contact member of an electrical connector, comprising:

a flat contact portion for contact with a mating contact member, and disposed along a support surface of a housing;

a flat press-fit fixing portion which is connected to the contact portion and is press-fitted into a press-fit hole of the housing;

a tine portion connected to said press-fit fixing portion; and a lug extending from a side surface of said press-fit fixing portion, wherein said lug includes a support piece and an inclined piece, the inclined piece being connected to the support piece and projecting to said support surface from said contact portion, and said inclined piece is disposed at a side opposite from said contact portion to urge said contact portion against the support surface.

2. The contact member according to claim 1, wherein the inclined piece which is extended from said support piece in a direction in which said mating contact member is inserted, with a tip end of it being inclined to be close to said support surface.

3. The contact member according to claim 1, wherein at least two lugs are provided at both side surfaces in a width direction of said press-fit fixing portion.

4. The contact member according to claim 2, wherein at least two lugs are provided at both side surfaces in a width direction of said press-fit fixing portion.

5. A holding structure of a contact member in which a press-fit fixing portion is press-fitted into a press-fit hole formed in a housing, and a contact portion is disposed along a support surface formed in said housing, wherein said contact member comprises:

a flat contact portion for contact with a mating contact member, being disposed along said support surface, a flat press-fit fixing portion which is connected to said contact portion, and is press-fitted into said press-fit hole, a tine portion connected to said press-fit fixing portion; and a lug extending from a side surface of said press-fit fixing portion, wherein said lug includes a support piece and an inclined piece, the inclined piece being connected to the support piece and projecting to said support surface side from said contact portion and said inclined piece is disposed at a side opposite from said contact portion with respect to said press-fit fixing portion, and said housing includes a pressing surface which presses said inclined piece of said lug to urge said contact portion against the support surface.

6. The holding structure of a contact member according to claim 5, wherein the inclined piece which is extended from said support piece in a direction in which said mating contact member is inserted, with a tip end of it being inclined to be close to said support surface, and a tip end of said inclined piece is pressed by said pressing surface.

7. The holding structure of a contact member according to claim 5, wherein at least two lugs are provided at both side surfaces in a width direction of said press-fit fixing portion, and said pressing surfaces are provided at both sides in a width direction of said press-fit hole.

8. The holding structure of a contact member according to claim 6, wherein at least two lugs are provided at both side surfaces in a width direction of said press-fit fixing portion, and said pressing surfaces are provided at both sides in a width direction of said press-fit hole.

9. An electrical connector comprising:

a first connector mounted on a first printed wiring board, and a second connector which mates with said first connector and mounted on a second printed wiring board, wherein any one of said first connector and said second connector includes a housing including a press-fit hole and a support surface and a plurality of contact members held in said housing, at least one of said contact members comprises:

a flat contact portion for contact with a mating contact member, which is disposed along said support surface, a flat press-fit fixing portion which is connected to said contact portion, and is press-fitted into said press-fit hole, a tine portion connected to said press-fit fixing portion; and a lug extending from a side surface of said press-fit fixing portion, wherein said lug includes a support piece and an inclined piece, the inclined piece being connected to the support piece and projecting to said support surface side from said contact portion and said inclined piece is disposed at a side opposite from said contact portion with respect to said press-fit fixing portion, and said housing includes a pressing surface which presses said inclined piece of said lug to urge said contact portion against the support surface.

10. The electrical connector according to claim 9, wherein the inclined piece which is extended from said support piece in a direction in which said mating contact member is inserted, with a tip end of it being inclined to be close to said support surface, and the tip end of said inclined piece is pressed by said pressing surface.

11. The electrical connector according to claim 9, wherein at least two lugs are provided at both side surfaces in a width direction of said press-fit fixing portion, and said pressing surfaces are provided at both sides in a width direction of said press-fit hole.

12. The electrical connector according to claim 10, wherein at least two lugs are provided at both side surfaces in a width direction of said press-fit fixing portion, and said pressing surfaces are provided at both sides in a width direction of said press-fit hole.

* * * * *

UNITED STATES PATENT AND TRADEMARK OFFICE

CERTIFICATE OF CORRECTION

PATENT NO. : 7,775,832 B2
APPLICATION NO. : 12/324171
DATED : August 17, 2010
INVENTOR(S) : Yoshinori Watanabe It is certified that error appears in the above-identified patent and that said Letters Patent is hereby corrected as shown below:

In column 9, line 66, "to said support surface side" should read -- to said support surface --.

In column 10, line 43, "to said support surface side" should read -- to said support surface --.

Signed and Sealed this

Sixteenth Day of November, 2010

David J. Kappos

David J. Kappos
*Director of the United States Patent and Trademark Office*